US006678485B1

(12) United States Patent
Odani

(10) Patent No.: US 6,678,485 B1
(45) Date of Patent: Jan. 13, 2004

(54) CONTROL PANEL DISPLAY FOR AN IMAGE PROCESSING APPARATUS

(75) Inventor: Makoto Odani, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 16 days.

(21) Appl. No.: 10/177,071

(22) Filed: Jun. 24, 2002

(51) Int. Cl.[7] ..... G03G 15/00
(52) U.S. Cl. ..... 399/81
(58) Field of Search ..... 399/81, 82, 85

(56) References Cited

U.S. PATENT DOCUMENTS 4,816,866 A * 3/1989 Yamada ..... 399/81
4,910,553 A * 3/1990 Suzuki ..... 399/81
4,975,734 A * 12/1990 Mishima ..... 399/81 X
5,200,778 A * 4/1993 Ito ..... 399/82
5,396,235 A * 3/1995 Maeshima et al. ..... 399/81 X
5,543,897 A * 8/1996 Altrieth, III ..... 399/81
5,832,337 A * 11/1998 Isemura ..... 399/81
5,999,765 A * 12/1999 Tomita ..... 399/81 X
6,058,276 A * 5/2000 Leveto ..... 399/81

FOREIGN PATENT DOCUMENTS

JP 7-114304 A 5/1995
JP 11-31040 A 2/1999

* cited by examiner

*Primary Examiner*—Fred L. Braun
(74) *Attorney, Agent, or Firm*—Foley & Lardner

(57) ABSTRACT

An image processing apparatus has an operation section for performing a predetermined display and a predetermined input. The image processing apparatus includes a first display device provided in the operation section and including a plurality of display sections to which a plurality of functions for performing image processing are respectively allocated, a second display device provided in the operation section and configured to display different indications with respect to a plurality of setting items set for each of the plurality of functions, a key which selects the functions, a key which selects the setting items, and a print section, in which indications of the functions respectively allocated to the display sections, indications of setting items that can be set by the functions and different indications for the respective setting items are printed near the plurality of display sections of the first display device.

7 Claims, 7 Drawing Sheets

| LED | Function allocated to LED |
|---|---|
| LED12 | Number of copies |
| LED13 | Magnification |
| LED14 | Output mode |
| LED15 | Regular magnification |
| LED16 | Cassette selection |
| LED17 | Print density |
| LED18 | Print mode |
| LED19 | Error display |

FIG. 4

| Setting items of output mode | 7-segment display |
|---|---|
| Single-sided>Double-sided | 1 |
| 2-in-1 landscape | 2 |
| 2-in-1 portrait | 3 |
| Double-sided>Double-sided | 4 |
| Double-sided>Single-sided | 5 |
| Single-sided>Double-sided | 6 |

FIG. 5

| Setting items of regular magnification | 7-segment display |
|---|---|
| 50% | 1 |
| 70% | 2 |
| 100% | 3 |
| 141% | 4 |
| 200% | 5 |

FIG. 6

| Setting items of cassette selection | 7-segment display |
|---|---|
| First cassette | 1 |
| Second cassette | 2 |
| Manual feed | 3 |

FIG. 7

| Setting items of print density | 7-segment display |
|---|---|
| Dark | 1 |
| Normal | 2 |
| Light | 3 |

FIG. 8

| Setting items of print mode | 7-segment display |
|---|---|
| Automatic | 1 |
| Photograph | 2 |
| Letters | 3 |
| Pictograph | 4 |
| Toner saving | 5 |

FIG. 9

| Detail of error | 7-segment display |
|---|---|
| Paper out | 1 |
| Toner out | 2 |
| Cover open | 3 |
| Paper jam (cassette) | 4 |
| Paper jam (scanner) | 5 |
| Drum display | 6 |

FIG. 10

CONTROL PANEL DISPLAY FOR AN IMAGE PROCESSING APPARATUS

BACKGROUND OF THE INVENTION

1. Field of the Invention

The present invention relates to an image processing apparatus, such as a multifunction apparatus, which receives function setting from an operation section for performing predetermined display and predetermined input.

2. Description of the Related Art

An image processing apparatus provided with an operation panel is sold. In such an image processing apparatus, various functions can be set by means of the operation panel. The operation panel has a structure, in which each of the functions is allocated to a setting key of a plurality of keys, and light-emitting diodes (LED) indicating that a setting item is selected are disposed.

When the operator operates the operation panel to change the setting of the function of the image processing apparatus, the operator selects a desired function by a setting key, and selects a setting item by means of display of an LED provided for each setting item of the selected function. Thus, the operator changes the setting.

For this reason, a number of keys and LEDs must be arranged on the operation panel: for example, setting keys for the respective functions and a plurality of LEDs for representing that the setting items are selected. Since many keys and LEDs are disposed, an inexpensive operation panel cannot be produced. Further, owing to a plurality of keys and LEDs, the operator cannot quickly set a function.

BRIEF SUMMARY OF THE INVENTION

An object of the present invention is to provide an image processing apparatus with an operation panel, in which keys and display of the operation panel are reduced without impairing the operability, so that the apparatus can be produced at low cost.

An image processing apparatus according to an aspect of the present invention has an operation section for performing a predetermined display and a predetermined input. The image processing apparatus includes: a first display device provided in the operation section and including a plurality of display sections to which a plurality of functions for performing image processing are respectively allocated; a second display device provided in the operation section and configured to display different indications with respect to a plurality of setting items set for each of the plurality of functions; a key which selects the functions; a key which selects the setting items; and a print section, in which indications of the functions respectively allocated to the display sections, indications of setting items that can be set by the functions and different indications for the respective setting items are printed near the plurality of display sections of the first display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 4 to 10 are diagrams showing tables stored in the memory;

DETAILED DESCRIPTION OF THE INVENTION

Embodiments of the present invention will now be described with reference to the drawings.

First Embodiment

Figure 1:
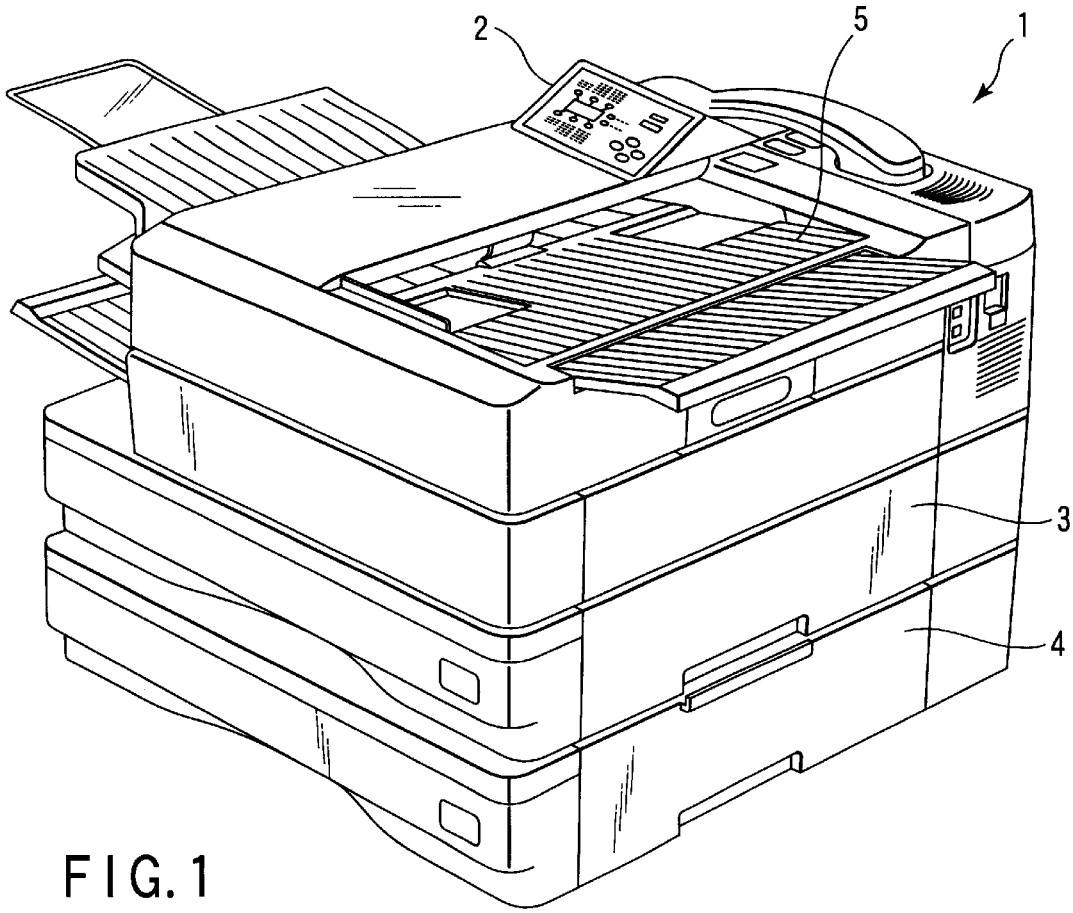
FIG. 1 is a diagram showing an appearance of a multifunction apparatus according to a first embodiment of the present invention.

A case, in which an image processing apparatus of the present invention is applied to a multifunction apparatus 1 shown in FIG. 1, will be described. The multifunction apparatus 1 has an operation panel 2. The multifunction apparatus 1 operates upon reception of an input through the operation panel 2. The multifunction apparatus 1 also includes a first cassette 3 and a second cassette 4 of a two-stage type, which store paper sheets, and a document table 5 on which a document to be copied is placed.

Figure 2:
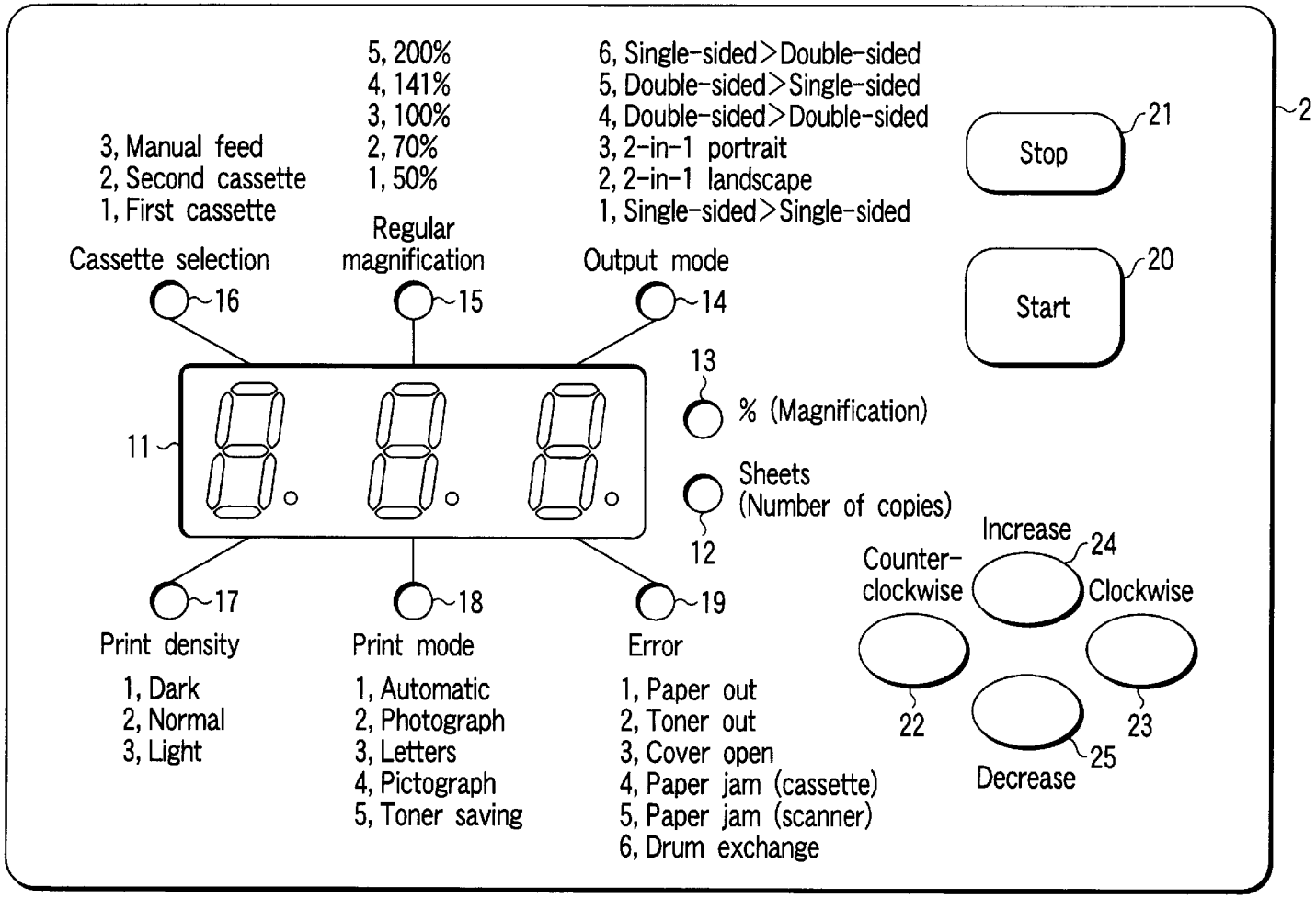
FIG. 2 is a diagram showing an operation panel of the multifunction apparatus.

As shown in FIG. 2, the operation panel 2 has a display section 11 including three seven-segment displays, and eight LEDs around the display section 11: an LED 12, an LED 13, an LED 14, an LED 15, an LED 16, an LED 17, an LED 18 and an LED 19. It also has six keys on the right side of the operation panel 2: a key 20, a key 21, a key 22, a key 23, a key 24 and a key 25.

Names of a plurality of functions for executing an image process, which can be set when LEDs are displayed, are printed near the LEDs 11 to 19 by means of, for example, silk screen printing. "Sheets (Number of copies)", indicative of the correspondence to a function of setting the number of sheets to be copied, is printed on the right of the LED 12. "% (Magnification)", indicative of the correspondence to a function of setting a magnification, is printed on the right of the LED 13. "Output mode", indicative of the correspondence to a function of setting an output mode, is printed above the LED 14. "Regular magnification", indicative of the correspondence to a function of setting a regular magnification, is printed above the LED 15. "Cassette selection", indicative of the correspondence to a function of selecting a cassette, is printed above the LED 16. "Print density", indicative of the correspondence to a function for setting a print density, is printed under the LED 17. "Print mode", indicative of the correspondence to a function of setting a print mode, is printed under the LED 18. "Error", indicative of the correspondence with a function of indicating an error, is printed under the LED 19.

Setting items to be set by each function are printed near the print portion of each function. Further, details of the error are printed near the print portion of error.

Six setting items are printed above the print of "output mode". The setting items are: "1, single-sided>double-sided", "2, 2-in-1 landscape", "3, 2-in-1 portrait", "4, double-sided>double-sided", "5, double-sided>single-sided", and "6, single-sided>double-sided".

Five setting items are printed above the print of "regular magnification". The setting items are: "1, 50%", "2, 70%", "3, 100%", "4, 141%" and "5, 200%".

Three setting items are printed above the print of "cassette selection". The setting items are: "1, first cassette", "2, second cassette" and "3, manual feed".

Three setting items are printed under the print of "print density". The setting items are: "1, dark", "2, normal" and "3, light".

Five setting items are printed under the print of "print mode". The setting items are: "1, automatic", "2, photograph", "3, letters", "4, pictograph" and "5, toner saving".

Six error details are printed under the print of "error". The details of error are: "1, paper out", "2, toner out", "3, cover open", "4, paper jam (cassette)", "5, paper jam (scanner)" and "6, drum exchange".

The key 20 is a print operation starting key. The key 21 is a print operation stopping key. The key 22 is a key for shifting the lighting of the LEDs counterclockwise, i.e., in the order of the LED 12, the LED 13, the LED 14, . . . the LED 18 and the LED 12. The key 23 is a key for shifting the lighting of the LEDs clockwise, i.e., in the order of the LED 12, the LED 18, . . . the LED 13 and the LED 12. The key 24 is a key for incrementing a numeral indicated by the seven segments in the display section 11. The key 25 is a key for decrementing a numeral formed by the seven segments in the display section 11.

Figure 3:
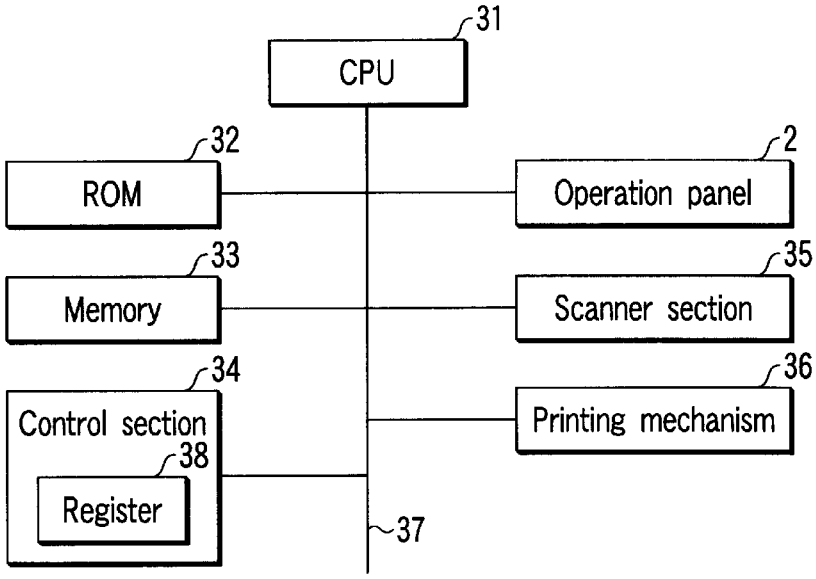
FIG. 3 is a block diagram showing a principal structure of the multifunction apparatus.

The principal structure of the multifunction apparatus 1 will now be described. FIG. 3 shows, a CPU 31, a ROM 32, a memory 33, a control section 34, a scanner section 35, a printing mechanism 36 and the operation panel 2. The CPU 31, the ROM 32, the RAM 33, the control section 34, the scanner section 35, the printing mechanism 36 and the operation panel 2 are connected by a system bus 37 or the like.

The CPU 31 controls the multifunction apparatus 1. The ROM 32 stores programs to be executed by the CPU 31, etc. The memory 33 is, for example, a DRAM, which stores tables and the like.

The memory 33 stores the tables as shown in FIGS. 4 to 10, in which the printing functions mentioned above are associated with the setting items that can be set by the respective functions. These tables show that the functions respectively allocated to the LED 14 to LED 19 and the setting items of each function in association with the corresponding seven-segment displays are stored in the memory.

The control section 34 controls printing operations and the like of the multifunction apparatus 1 under the control of the CPU 31. The control section 34 includes a register 38. The register 38 temporarily stores setting of functions for carrying out printing. The control section 34 turns on a predetermined LED of the LED 12 to LED 18 in accordance with a predetermined key operation by the operator, and displays a predetermined numeral with the seven segments of the display section 11. Further, if an error occurs in the multifunction apparatus 1, the control section 34 displays in the LED 19 a predetermined numeral corresponding to the detail of the error.

The settings temporarily stored in the register 38 are, in the initial settings, for example, the output mode "single-sided>single-sided", the regular magnification "100%", the cassette "the first cassette", the print density "normal", and the print mode "automatic".

The scanner section 35 reads an image on the document fed from the document table 5. The printing mechanism 36, controlled by the control section 34, prints the image read by the scanner section 35.

Figure 11:
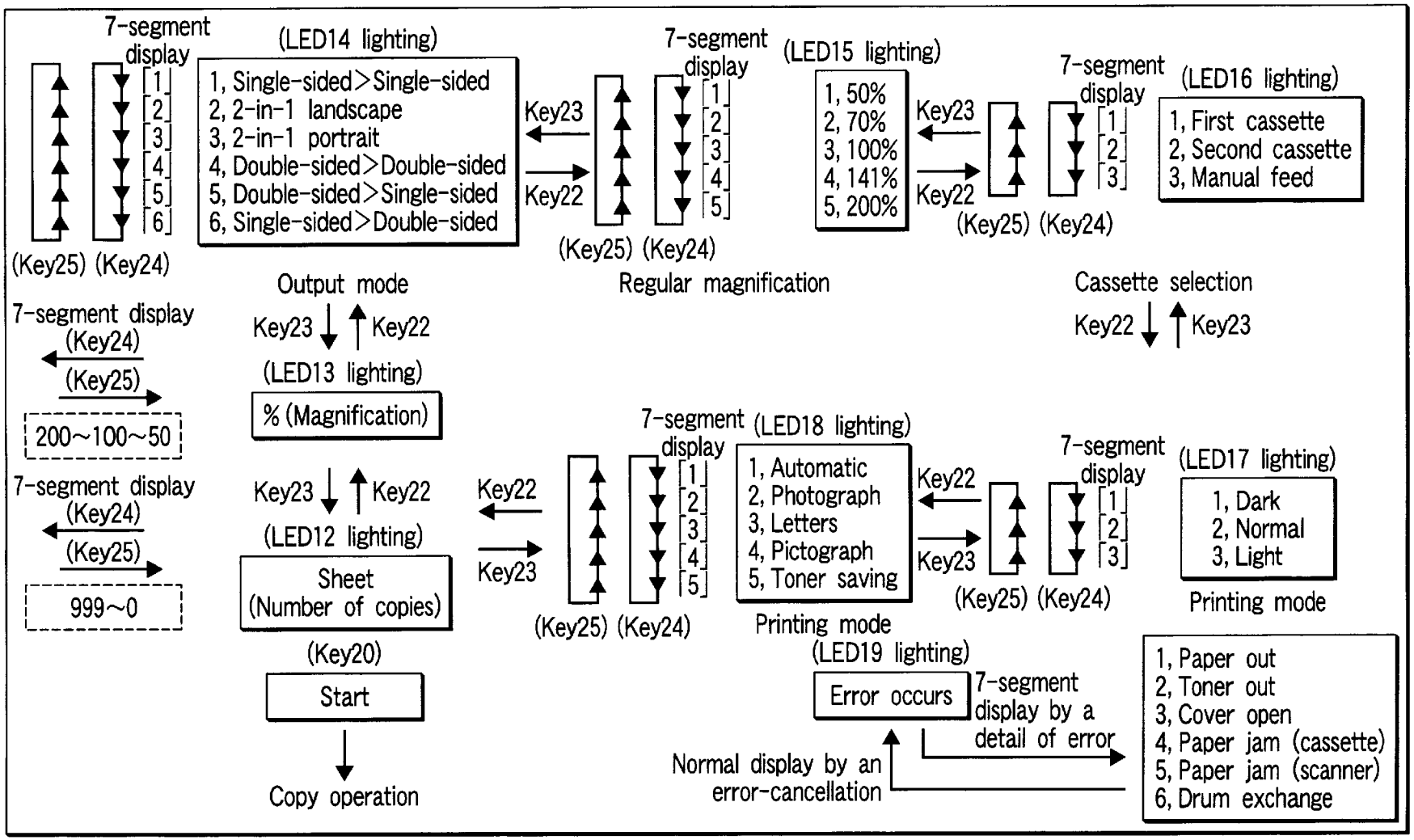
FIG. 11 is a diagram illustrating a flow of a change in function and setting item.

Referring to FIG. 11, an operation will be described, in which the settings of the functions are changed when the operator performs printing with the multifunction apparatus 1 by operating the operation panel 2.

In the normal state, the initial settings are read out and temporarily stored in the register 38. Therefore, in the operation panel 2, the LED 12 is lighted and the seven segments display "1". At this time, if the operator depresses the key 20 once, the scanner section 35 reads an image and the printing mechanism 36 is operated and makes a copy of the read image.

To change functions of the multifunction apparatus 1 from the normal state, the operator depresses the key 22 or the key 23. For example, if the operator depresses the key 22 once, the LED 12 is turned off and the LED 13 is turned on. If the operator depresses the key 22 once again, the LED 13 is turned off and the LED 14 is turned on. In this state, if the operator depresses the key 23 once, the LED 14 is turned off and the LED 13 is turned on.

In this manner, each time the operator depresses the key 22 from the initial state, the lighting of the LED is shifted as follows: the LED 12→the LED 13→the LED 14→the LED 15→the LED 16→the LED 17→the LED 18→the LED 12. Further, each time the operator depresses the key 23 from the normal state, the lighting of the LED is shifted as follows: the LED 12→the LED 18→the LED 17→the LED 16→the LED 15→the LED 14→the LED 13→the LED 12.

Assuming that the operator depresses the key 22 twice from the normal state to turn on the LED 13, the output mode is selected as the function, the setting of which is to be changed. If this selection is made, the setting of the register 38 is read and "1" is displayed in the seven-segment display.

To change the setting of the output mode, the operator depresses the key 24 or the key 25. Each time the operator depresses the key 24, the seven-segment display is changed as follows: 1→2→3→4→5→6→1. Each time the operator depresses the key 25, the seven-segment display is changed as follows: 1→6→5→4→3→2→1.

For example, to perform "double-sided>double-sided" printing, the operator depresses the key 24 three times to display "4" in the seven-segment display. The function and the setting item of the function are thus selected.

Then, the setting of the multifunction apparatus 1 is changed such that the output mode is "double-sided>double-sided". When the operator depresses the key 20 at this time, a copying operation with a setting of the output mode changed from the initial setting, that is, the multifunction apparatus 1 makes one double-sided copy.

Assume that the operator is to change the settings from the initial state as follows: the number of copies: 10, the finishing: 2-in-1, the paper selection: second, and the print mode: letters. The copying operation in this case will be described.

First, the key 22 is depressed twice, to turn on the LED 14. At this time, the control section 34 reads the setting of the register 38. The seven-segment display displays "1". Subsequently, when the key 24 is depressed once, the seven-segment display displays "2". Thus, the setting of the output mode is changed to 2-in-1.

In this state, when the operator depresses the key 22 once, the content of the changed setting is written in the register 38 and the LED 15 is turned on. Then, when the operator depresses the key 22 once again, the LED 16 is turned on.

At this time, the setting is read from the register 38 and "1" is displayed on the seven-segment display. When the operator depresses the key once, the display of the seven-segment display is changed to "2". Thus, the setting of the cassette selection is changed to the second cassette.

In this state, when the operator depresses the key 22 once, the content of the changed setting is written in the register 38 and the LED 17 is turned on. Then, when the operator depresses the key 22 once again, the LED 18 is turned on.

At this time, the setting is read from the register 38 and "1" is displayed on the seven-segment display. When the operator depresses the key 24 twice, the display of the seven-segment display is changed to "3". Thus, the setting of the print mode is changed to letters.

In this state, when the operator depresses the key 22 once, the content of the changed setting is written in the register 38 and the LED 12 is turned on.

At this time, the setting is read from the register 38 and "1" is displayed on the seven-segment display. When the operator depresses the key 24 nine times or for a long time, the display of the seven-segment display is changed to "10".

In this state, when the operator depresses the key 20, the content of the changed setting is written in the register 38. Then, the multifunction apparatus 1 starts copying to make ten copies.

During the printing operation, if the CPU 31 detects occurrence of an error at any position, it turns on the LED 19 and causes the seven-segment display to display a numeral corresponding to the error allocated to the detail of the error. When the CPU 31 detects recovery from the error, it cancels the error display and returns the display to the normal state.

According to the first embodiment, the operation panel 2 includes the LED 12 to the LED 19 provided in the display section 11, the function allocated to each LED and the setting items associated with the indications of the seven-segment display are printed near the LED. Therefore, the number of LEDs and keys provided in the operation panel can be considerably reduced.

Accordingly, the operation panel 2 can be manufactured at lower cost, so that a lower-cost multifunction apparatus can be provided.

Further, while selecting a function and a setting item, the operator can observe the LED turned on at any position and the setting item, which is printed near the LED and corresponds to the display of the seven-segment display. Therefore, the setting can be changed easily without impairing the operability.

Second Embodiment

A second embodiment will now be described. The same parts as those of the above-described embodiment are identified by the same reference numerals, and detailed descriptions thereof are omitted.

Figure 12:
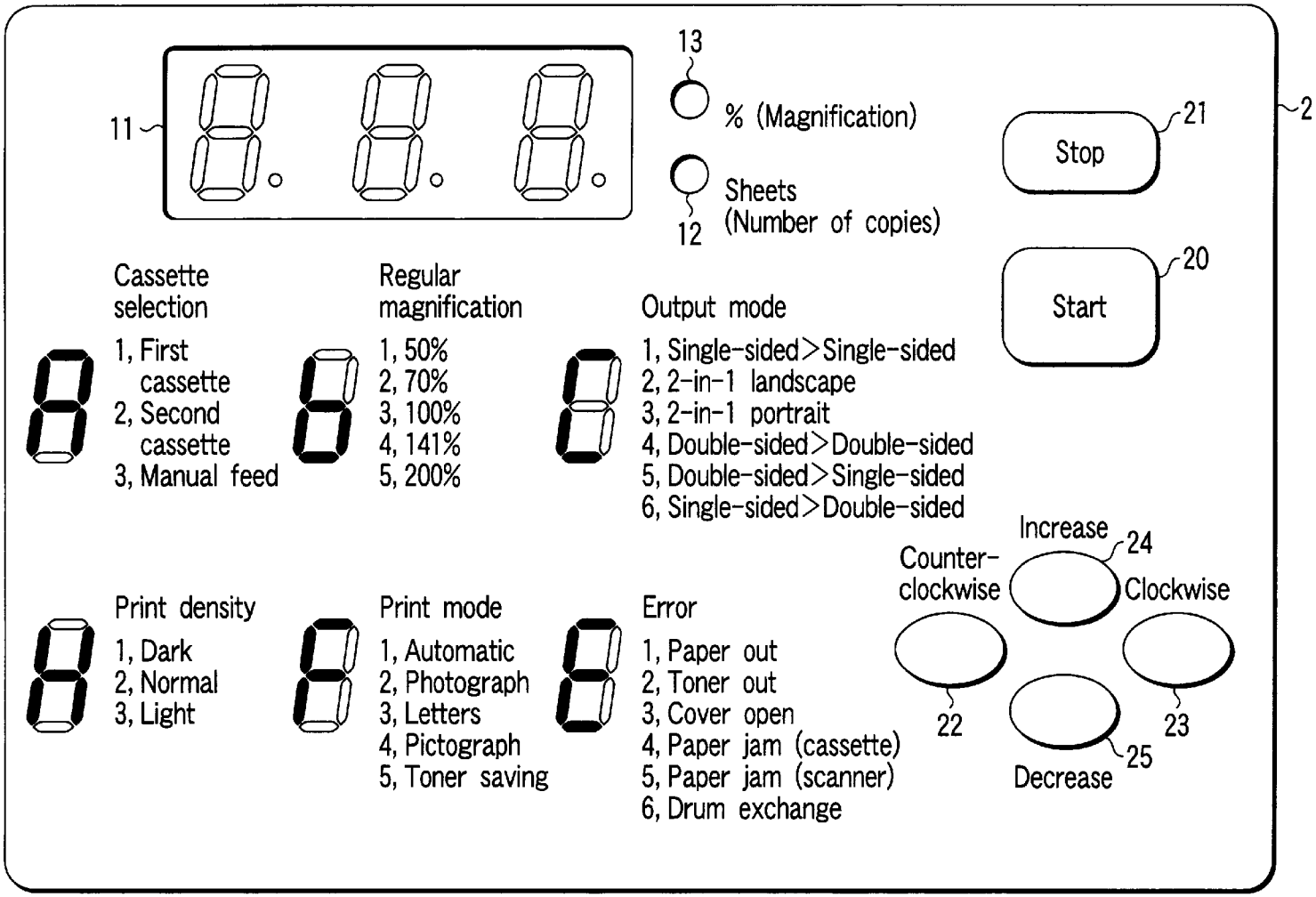
FIG. 12 is a diagram showing an operation panel of a multifunction apparatus according to a second embodiment of the present invention.

In the operation panel 2 of this embodiment, as shown in FIG. 12, a display section 11 including three seven-segment displays is arranged in an upper left portion. LEDs 12 and 13 are arranged on the right of the display section 11, as in the first embodiment. A key 21, a key 22, a key 23, a key 24, a key 25 and a key 26 are also provided likewise.

Unlike in the first embodiment, there are only two LEDs: the LED 12 indicative of the function of the number of copies; and the LED 13 indicative of the function of magnification. The other functions are displayed by means of alphabet letters the instead of the lighting of LEDs. In this embodiment, the seven-segment displays display the cassette selection as "A", the regular magnification as "b", the output mode as "C", the print density as "H", the print mode as "F" and the error as "E".

Under the display section 11, the cassette selection, the setting items thereof and the display patterns of the seven segments corresponding to the setting items are printed along with the print "A". The regular magnification, the setting items thereof and the display patterns of the seven segments corresponding to the setting items are printed along the print "b". The output mode, the setting items thereof and the display patterns of the seven segments corresponding to the setting items are printed along the print "C".

Under these prints, the print density, the setting items thereof and the display patterns of the seven segments corresponding to the setting items are printed along with the print "H". The print mode, the setting items thereof and the display patterns of the seven segments corresponding to the setting items are printed along with the print "F". The error, the details of the error and the display patterns of the seven segments corresponding to the details of the error are printed along with the print "E".

When the operator depresses the key 22 or the key 23, a function is selected. The letter "A", "b", "C", "H", "F", "E" or the like is displayed in the seven-segment display for selection. When the operator depresses the key 24 or the key 25, a numeral can be displayed in the seven-segment display, so that the setting item can be changed.

According to the second embodiment, the display section 11 can display a plurality of functions with different alphabet display patterns of the seven-segment display, and different numerals corresponding to the setting items for each function. Under the display section 11, the alphabet letters, the functions corresponding to the alphabet letters, the setting items set by the functions and the display patterns of the seven segments corresponding to the setting items are printed. Therefore, the same effect as in the above embodiment can be obtained.

Moreover, the number of LEDs can be less than that in the first embodiment.

Further, in each of the above embodiments, the setting items set for each function are indicated by different indications of the seven-segment display. However, the setting items may be displayed by means of liquid crystal which is inexpensive, for example, a display that can merely turn black pixels white and vice versa. In this case, the same effect can also be obtained.

Furthermore, each of the above embodiment has the two function selecting keys: the key 22 for selecting clockwise and the key 23 for selecting counterclockwise, and the two setting item selecting keys: the key 24 for incrementing the numeral indicated by the seven segments and the key 25 for decrementing the numeral indicated by the seven segments. However, each of the function selecting keys and the setting item selecting keys may be reduced to one. With this structure, the operation panel can be much lower in cost.

The embodiments, in which the image processing apparatus is applied to a multifunction apparatus, have been described. However, the present invention is not limited thereto, but can be applied to any image processing apparatus in which the operation panel of the embodiments described above can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image processing apparatus having an operation section for performing a predetermined display and a predetermined input, said apparatus comprising:

a first display device provided in the operation section and including a plurality of display sections to which a plurality of functions for performing image processing are respectively allocated;

a second display device provided in the operation section and configured to display different indications with respect to a plurality of setting items set for each of the plurality of functions;

a key which selects the functions;

a key which selects the setting items; and a print section, in which indications of the functions respectively allocated to the display sections, indications of setting items that can be set by the functions and different indications for the respective setting items are printed near said plurality of display sections of the first display device.

2. The image processing apparatus according to claim 1, wherein the first display device comprises light-emitting diodes respectively provided for the functions.

3. The image processing apparatus according to claim 1, wherein the second display device comprises a seven-segment display.

4. The image processing apparatus according to claim 3, wherein the different indications are numerals formed by the seven-segment display.

5. An image processing apparatus having an operation section for performing a predetermined display and a predetermined input, said apparatus comprising:

a display device which is provided in the operation section, and displays a plurality of functions for performing image processing with different indications of a first type respectively allocated to the functions and a plurality of setting items set for said plurality of functions with different indications of a second type;

a key which selects the functions;

a key which selects the setting items; and a print section, in which said different indications of the first type, indications of the functions allocated to said indications, indications of setting items set by the functions and said different indications of the second type for the setting items are printed near the display device.

6. The image processing apparatus according to claim 5, wherein the display device comprises a seven-segment display.

7. The image processing apparatus according to claim 6, wherein the first type is alphabetic and the second type is numerical.

* * * * *